US007311035B2

(12) United States Patent
Reynolds

(10) Patent No.: US 7,311,035 B2
(45) Date of Patent: Dec. 25, 2007

(54) SUBSEA HYDRAULIC JUNCTION PLATE ACTUATOR WITH R.O.V. MECHANICAL OVERRIDE

(75) Inventor: Graeme Edwin Reynolds, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 142 days.

(21) Appl. No.: 11/330,616

(22) Filed: Jan. 12, 2006

(65) Prior Publication Data

US 2006/0180313 A1 Aug. 17, 2006

Related U.S. Application Data

(60) Provisional application No. 60/652,375, filed on Feb. 11, 2005.

(51) Int. Cl.
*E21B 43/01* (2006.01)
*F15B 15/06* (2006.01)

(52) U.S. Cl. ..... 92/136; 166/338

(58) Field of Classification Search ..... 92/33, 92/136; 166/338, 341
See application file for complete search history.

(56) References Cited

U.S. PATENT DOCUMENTS

| | | | | |
|---|---|---|---|---|
| 3,586,048 | A | 6/1971 | Arnold | |
| 3,688,840 | A | 9/1972 | Curington et al. | |
| 4,035,005 | A | 7/1977 | DeVincent et al. | |
| 4,566,489 | A | 1/1986 | Knapp et al. | |
| 4,730,677 | A | 3/1988 | Pearce et al. | |
| 4,943,187 | A * | 7/1990 | Hopper | 166/341 |
| 5,265,980 | A | 11/1993 | Lugo et al. | |
| 5,333,691 | A | 8/1994 | Dean et al. | |
| 5,466,017 | A | 11/1995 | Szabo et al. | |
| 5,794,701 | A * | 8/1998 | Cunningham et al. | 166/341 |

FOREIGN PATENT DOCUMENTS

DE 28 11 212 A1 3/1978

* cited by examiner

*Primary Examiner*—Thomas E. Lazo
(74) *Attorney, Agent, or Firm*—Duane Morris LLP

(57) ABSTRACT

The invention relates to the field of offshore subsea oil and gas drilling and production operations. Specifically the invention relates to a hydraulically and/or mechanically driven junction plate actuator suitable for use in connecting and/or disconnecting a dynamic junction box half to a fixed junction box assembly.

20 Claims, 6 Drawing Sheets

SUBSEA HYDRAULIC JUNCTION PLATE ACTUATOR WITH R.O.V. MECHANICAL OVERRIDE

CROSS REFERENCE TO RELATED APPLICATIONS

This application claims priority from provisional application Ser. No. 60/652,375, filed Feb. 11, 2005.

BACKGROUND OF THE INVENTION

1. Field of the Invention

The invention relates to the field of offshore subsea oil and gas drilling and production operations. Specifically the invention relates to a hydraulically and/or mechanically driven junction plate actuator suitable for use in connecting and/or disconnecting a dynamic junction box half to a fixed junction box assembly.

2. Description of the Prior Art

Disconnectable hydraulic and electrical junction boxes are utilized in many subsea control and intervention applications. These applications include subsea blowout preventer (B.O.P.) stacks, production trees, production tree installation and workover systems, manifold systems, and interface systems. The applications may include direct control interfaces where remote installation is necessary and back up (intervention) to a main control module in the event of system failure.

Current disconnectable junction box assemblies consist of a fixed plate containing both checked and balanced hydraulic couplers and in some cases wet make/break electrical couplers. The fixed plate is mounted to the junction box assembly. A particular coupler can interface to the function to be controlled via hard pipe, hydraulic hose, or electrical pigtails.

The matching or dynamic plate containing the male or female coupler half interfaces to the fixed plate and is locked in place providing communication from the dynamic plate umbilical or cable through the couplers or electrical connector. In some cases, this mating interface is accomplished by utilizing a remote operated vehicle (R.O.V.) to manipulate the dynamic junction half to the assembly receiver interface via a flying-lead assembly.

Prior art systems employed for installation and makeup of a junction plate assemblies have consisted of a keyed female receiver funnel and matching male plug assembly, which is keyed and locked into the female receiver via the R.O.V. tooling end effector or coupling which rotates the locking dogs or similar detent mechanism in place. In turn, a mechanical screw, also driven by the R.O.V. tooling end effector, provides the makeup and breakout of the dynamic junction plate half to the fixed junction plate half.

The functionality of the prior art system described above is limited. For example, there are cases where hydraulic extend/retract functionality is desired. In such cases, hydraulic actuation to make and break the junction box halves provides the means to disconnect and retract the dynamic junction box half from the fixed assembly without intervention from the remote operated vehicle (R.O.V.). This may be advantageous in operations where the R.O.V. is being used for alternate tasks or is on surface for servicing or repair.

Additionally, there are distinct advantages in some applications in having a manual mechanical override function in the case of hydraulic system failure. This provides a redundancy provision in the method of operation providing the means for both hydraulic and mechanical actuation. Prior art systems do not provide a combined hydraulic and manual mechanical override capability, and are thus limited in functionality.

DESCRIPTION OF THE PREFERRED EMBODIMENTS

A preferred embodiment of the invention is directed to a hydraulically actuated junction plate with integral mechanical override. In a preferred embodiment, the assembly comprises of a hydraulic actuating cylinder, which is designed with a hollow piston rod equipped with a machined screw profile in one (1) end. The rod bore contains a mechanical screw with an acme thread profile upset allowing for the screw to rotate through the piston bore. In turn, the mechanical screw is machined with a broached spline profile (female) in one end to accept a male spline which is allowed to slip-in and out-of the screw spline bore creating a slip-joint action between the screw and the male spline.

Figure 3A:
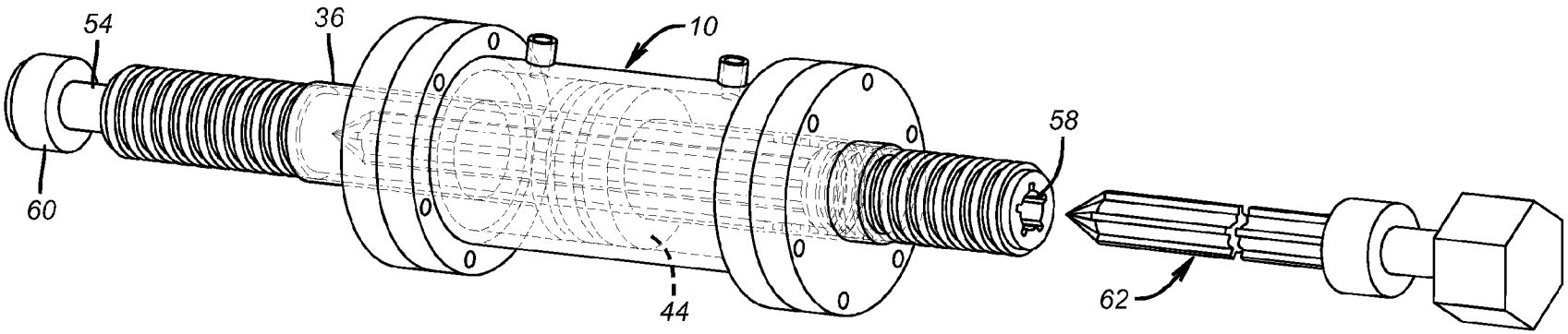
FIG. 3*a* is an isometric view of a preferred embodiment of the present invention.
Figure 3B:
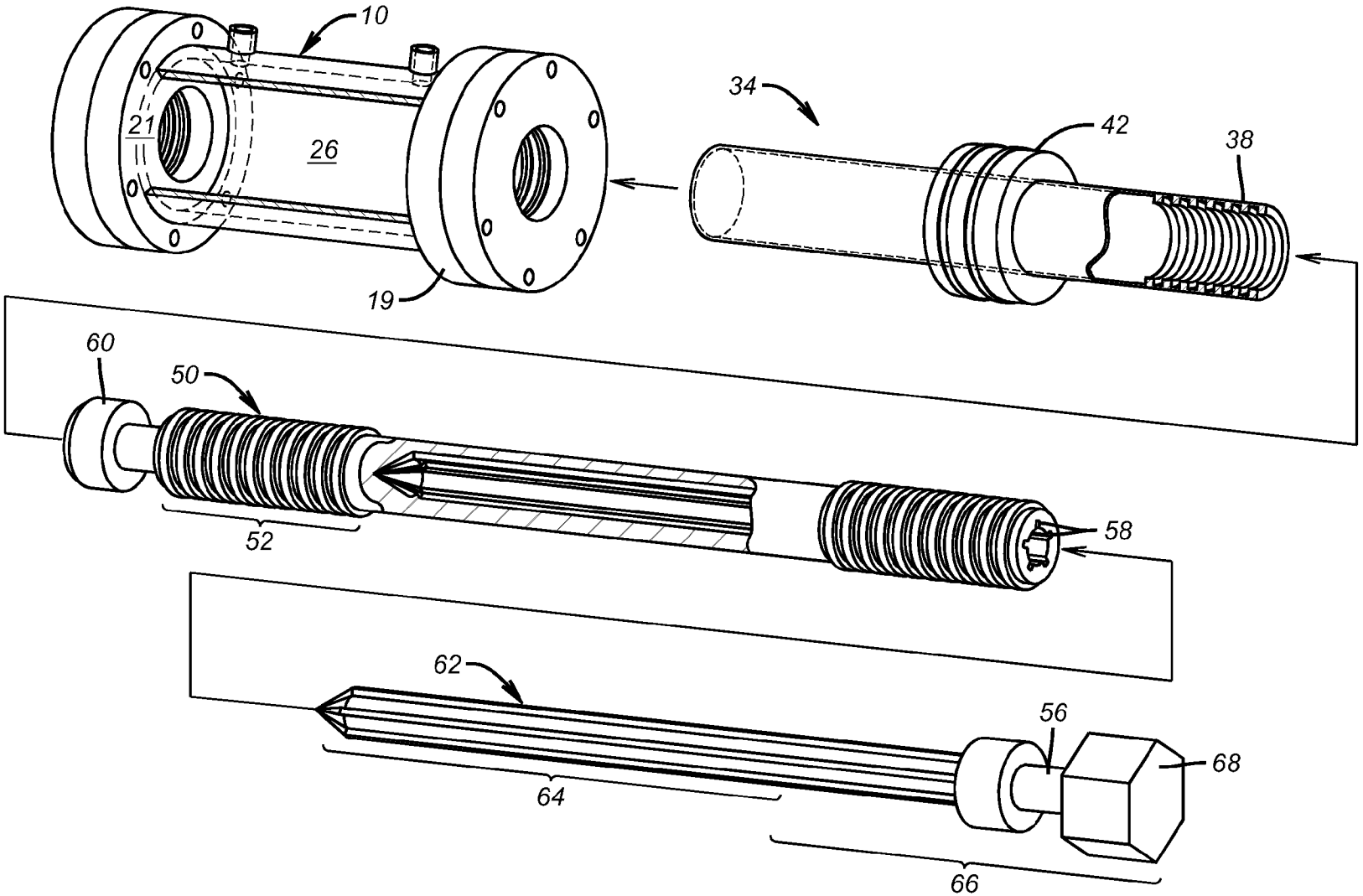
FIG. 3*b* is an exploded isometric view of a preferred embodiment of the present invention.
Figure 4:
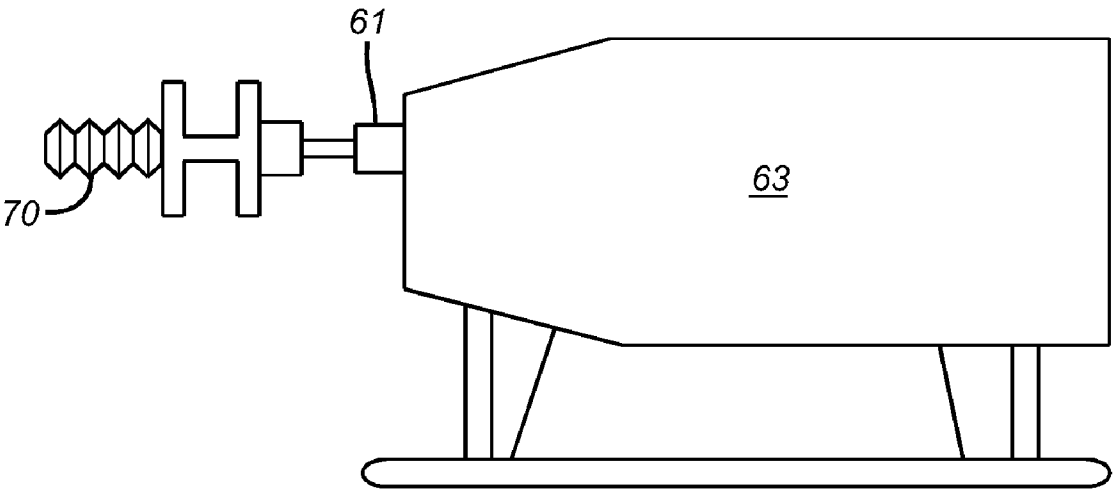
FIG. 4 is a side view of an embodiment of the invention where an R.O.V. equipped with a bucket is coupled to the coupling member of the present invention.

In a preferred embodiment, the mechanical screw is arranged with a flange end for attachment to the junction plate half containing the hydraulic and electrical couplers and the female spline end for interface to the male drive spline In a preferred embodiment, the male drive spline 62 is machined with an R.O.V. drive profile nut and is captured in the R.O.V. intervention female receptacle (bucket) 61 designed to accommodate the R.O.V. end effector tooling unit, as shown in FIGS. 3*a*, 3*b*, and 4. By rotating the drive spline, the mechanical screw drives both the hydraulic cylinder piston which when bottoms out in the cylinder bore, overrides the hydraulics and drives the junction plate in forward (in) or reverse (out).

In a preferred embodiment, the cylinder piston rod is also equipped with a flange boss containing and anti-rotation rod, which slides in a bushing contained in a flange, which is integral to the cylinder. This alleviates the potential for the piston rod and piston to rotate in the cylinder due to the torque transferred from the screw during rotation.

In a preferred embodiment, the initial application for the junction box assembly relates to a subsea blow out preventer stack discrete hydraulic control pod. The control pod interfaces to the surface control manifold via hydraulic hose bundles containing separate pilot lines. The hose bundle terminates at a fixed junction box at the top of each control pod and is supported by individual hose-to-wireline clamps attached to a wireline. The wireline also attaches to the pod top and is used for running and retrieving each individual pod for repair. During running and retrieving operations, the hose bundle is pulled and spooled on to its storage reel along with the wireline subjecting the hose bundle to damage and in turn rig downtime and in many cases hose bundle replacement cost.

In a preferred embodiment, application of the disconnectable junction box assemblies allows for the existing hose bundle to remain static by clamping it to the marine riser and retrieving the pod independently of the hose bundle.

In a preferred embodiment directed to a B.O.P. stack application, the existing hose bundle terminates at a fixed junction box assembly mounted to the lower marine riser package (L.M.R.P.). In turn, a flexible hose bundle length is run to the disconnectable junction box assembly dynamic (or movable) half.

The flexible hose bundle individual pilot or supply hoses interface with balanced couplings located on the junction plate face. Individual assigned pilot hoses are connected to the hydraulic cylinder ports for operation of the extend/retract functions from the surface unit. The assemblies are adaptable to all existing subsea control pods and systems using discrete hydraulic hose bundle assemblies.

The preferred embodiments described below are depicted in FIGS. 1, 2*a*, 2*b*, 3*a*, and/or 3*b*. In another preferred embodiment, the invention comprises a cylinder 10 having an outer wall 12 having an inner surface 14 and an outer surface 16, a first fluid region 18, a first fluid port 20 in the wall at the location of the first fluid region, a second fluid region 22 adjacent to the first fluid region, a second fluid port 24 in the wall at the location of the second fluid region, a longitudinal channel 26 extending through a central radial region the first and second fluid regions, first face 19 at the end of the first fluid region, and a second face 21 at the end of the second fluid region This embodiment further comprises a first fluid line 30 coupled to the first fluid port, and a second fluid 32 line coupled to the second fluid port. In a preferred embodiment, the first and second faces comprised one or more elastemeric sealing members 31 to provide a fluid seal with a member, such as a piston, which may travel through the longitudinal channel. In a preferred embodiment the elastomeric sealing members are o-rings.

Hydraulic fluid can be injected into either the first or second fluid region through the first or second fluid port and ejected from the other of the first or second fluid region through the respective fluid port. This embodiment of the invention further comprises a piston 34 extending through the central channel of the cylinder and having a distal end 36 protruding beyond either first or second fluid region, a proximal end 38 protruding beyond the fluid region of the cylinder opposite the region beyond which the distal end protrudes, and a threaded central longitudinal channel 40.

This embodiment of the invention further comprises a diaphragm 42 mounted on the piston and sized such that it extends radially outward from the outer surface of the piston to the inner surface of the cylinder outer wall. The diaphragm comprises a first face 44 defining a boundary of the first fluid region, and a second face 46 defining a boundary of the second fluid region.

Figure 1:
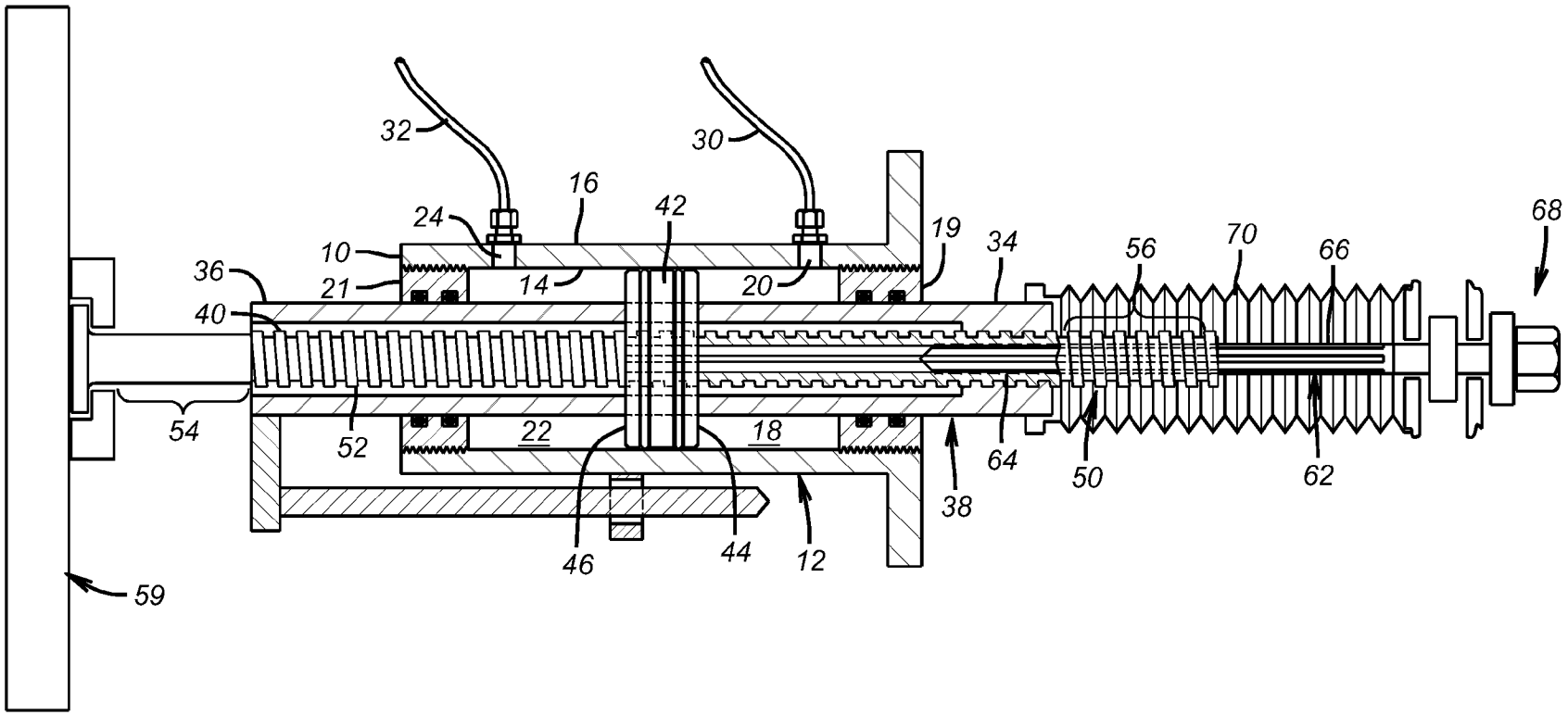
FIG. 1 is a side cross sectional view of a preferred embodiment of the invention.
Figure 2A:
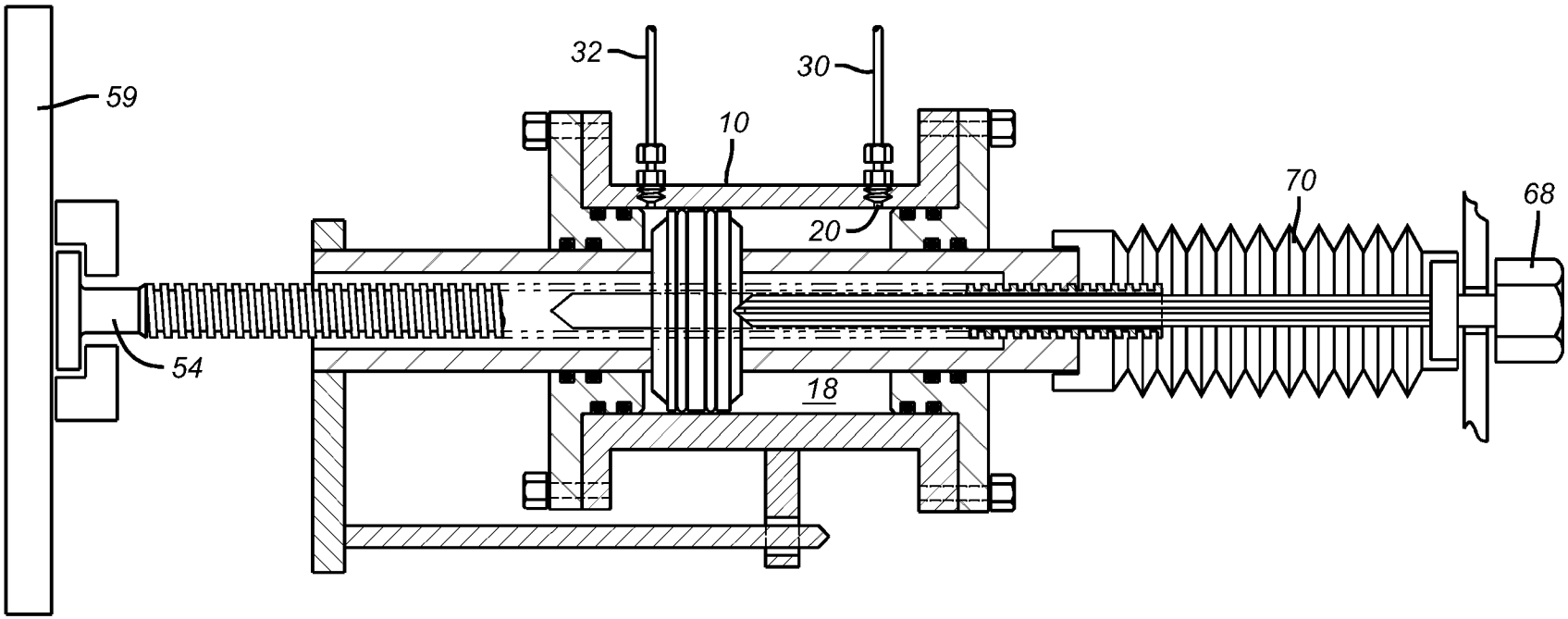
FIG. 2*a* is a side cross sectional view of the preferred embodiment of FIG. 1 with the piston full stroked in the direction of the junction plate or extended position.
Figure 2B:
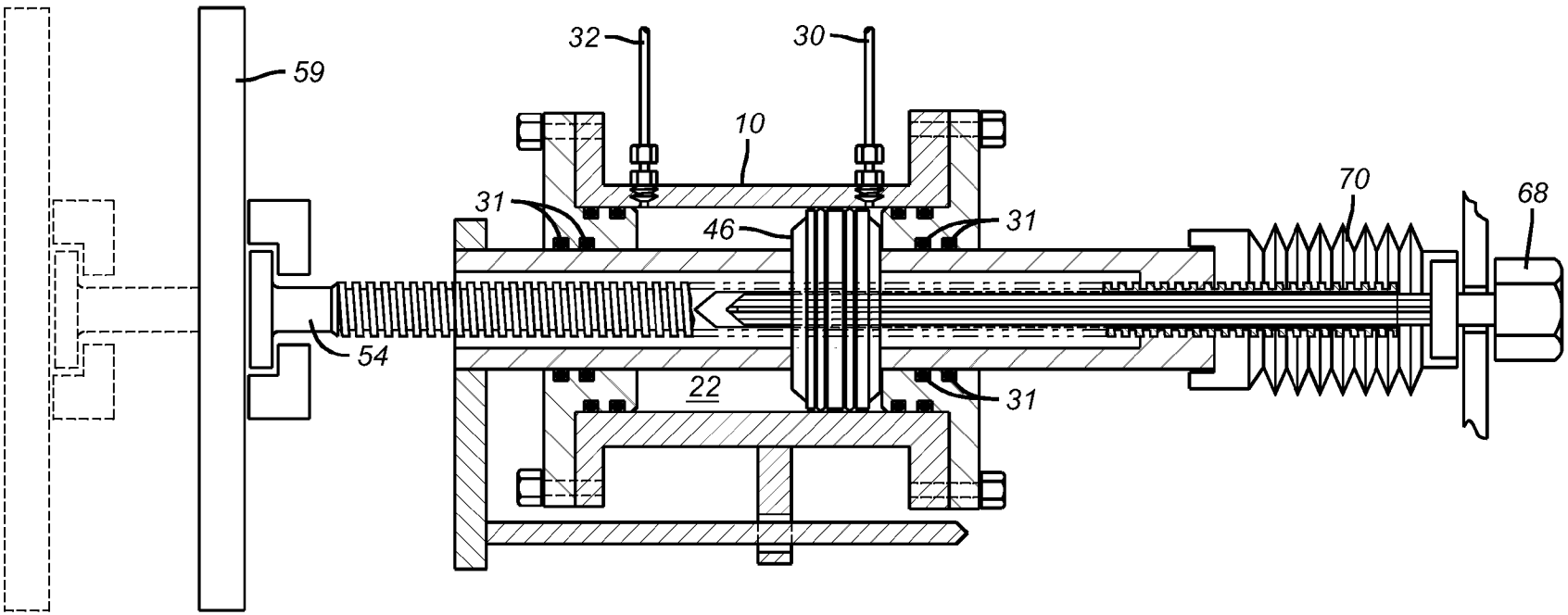
FIG. 2*b* is a side cross sectional view of the preferred embodiment of FIG. 1 with the piston full stroked in the direction of the proximal section of the drive spline or retracted position.

In the preferred embodiment shown in FIG. 1, hydraulic fluid entering the first fluid region through the first fluid port causes the diaphragm and piston to move longitudinally toward the second fluid region. The movement of the diaphragm and piston toward the second fluid region causes hydraulic fluid to exit through the second fluid port and through the second fluid line. In FIG. 2*a*, the piston is shown fully extended in the direction of the second fluid region. Conversely, hydraulic fluid entering the second fluid region through the second fluid port causes the diaphragm and piston to move longitudinally toward the first fluid region, thereby causing fluid to exit through the first fluid port and the first fluid line. In FIG. 2*b*, the piston is shown fully retracted in the direction of the first fluid region.

The first and second fluid lines can be connected to a source of hydraulic fluid and a valve system of the type known to those skilled in the art such that the injection of hydraulic fluid can be alternated, as a user desires, through either the first fluid line or the second fluid line. Longitudinal movement of the piston and the diaphragm can be reciprocated by alternating which of the first or second fluid line is the hydraulic fluid injection or inlet line, and which of the first or second fluid line is the hydraulic fluid ejection or outlet line. As the diaphragm reciprocates longitudinally, the volume of the first fluid region and the volume of the second fluid region change. The total volume of the first and second fluid region will remains constant. The use of hydraulic fluid injected into either the first fluid region or the second fluid region, as described above, is an embodiment of hydraulic actuation of the present invention.

In a preferred embodiment, the threaded central longitudinal channel of the piston comprises the female threads. This embodiment of the invention further comprises a screw member 50 comprising a threaded region 52 rotatably mounted in the central longitudinal channel of the piston, a distal region 54 extending beyond the distal end of the piston, and a proximal region 56 extending beyond the proximal end of the piston.

In a preferred embodiment, the central longitudinal channel of the piston comprises female threads and the threaded region of the screw member comprises matable male threads. Rotation of the screw member with respect to the piston results in longitudinal movement of the screw member relative to the piston. In such relative motion, the screw member may move longitudinally while the piston remains in a fixed longitudinal position. Alternatively, in such relative motion, the piston may move longitudinally while the screw member remains in a fixed longitudinal position.

The screw member further comprises at least one internally positioned longitudinal spline receptacle 58, such as a keyway. Such a spline receptacle is shown in FIGS. 3*a* and 3*b*. In other preferred embodiments, the screw member may contain several longitudinal spline receptacles. In a preferred embodiment, the screw member contains at least two spline receptacles positioned on radially opposite sides of the screw member. In general, increasing the number of spline receptacles makes it easier to align a splined member with the screw member.

The distal region of the screw member is adapted to be connectable to a junction plate half 59 which may contains hydraulic and/or electrical couplers. Such adaptation may be accomplished, in a preferred embodiment, by having a flange member 60 attached to the distal end region of the screw member. In another preferred embodiment, as shown in FIG. 1, the junction plate half 59 is attached to the flange member 60.

In a preferred embodiment, the invention further comprises a drive spline 62 having, a distal section 64 inserted in the spline receptacle of the screw member such that rotation of the spline member causes rotation of the screw member, and a proximal section 66 opposite the distal section, comprising a coupling member 68 attached to the end of the proximal section. In a preferred embodiment, the distal section of the drive spline comprises a conical end region.

In a preferred embodiment, the coupling member 68 is a hexagonal head adapted to be received within a hexagonal socket, as shown in FIGS. 3*a* and 3*b*. Those skilled in the art will be familiar with hexagonal sockets or buckets 61 commonly used on R.O.V.'s 63 that are suitable to be coupled to the coupling member such that the rotation of the socket causes rotation of the coupling member. In FIG. 4, the coupling member 68 is contained within female receptacle 61 that is attached to the R.O.V. 63.

In a preferred embodiment, rotation of the coupling member causes rotation of the drive spline, which in turn causes rotation of the screw member, resulting in longitudinal movement of the screw member relative to the piston, as described above. Such longitudinal movement of the screw member results in longitudinal movement of a junction plate attached to the distal region of the screw member. The use of mechanical torque to rotate the coupling member, resulting in the combined rotational and longitudinal movement described above, provides a means for mechanical override and/or operation of the present invention. This mechanical override mode can be used to operate the present invention in the absence of hydraulic fluid pressure. Thus, as explained above, longitudinal movement of the screw member can be achieved by hydraulic actuation, or by rotational movement of the coupling member.

In a preferred embodiment, the invention further comprises a flexible bellows 70 extending between the coupling member and the proximal end of the piston.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. A junction plate actuator apparatus comprising:

a. a cylinder comprising a wall, a first fluid region, a first fluid port in the wall located at the first fluid region, a second fluid region, a second fluid port in the wall at the second fluid region, a longitudinal channel extending through a central radial region of the first and second fluid regions, a first face at the end of the first fluid region and a second face at the end of the second region;

b. a first fluid line coupled to the first fluid port;

c. a second fluid line coupled to the second fluid port;

d. a piston extending through the central channel of the cylinder and comprising a distal end protruding beyond the first or second fluid region of the cylinder, a proximal end protruding beyond the fluid region of the cylinder opposite the region from which the distal end protrudes, and a threaded longitudinal channel;

e. a diaphragm mounted on the piston and sized such that it extends radially outward from the outer surface of the piston to the cylinder wall;

f. a screw member comprising a threaded region rotatably mounted in the central longitudinal channel of the piston, a distal region extending beyond the distal end of the piston and adapted to be connectable to a junction plate, a proximal region extending beyond the proximal end of the piston, and a longitudinal spline receptacle; and g. a drive spline having a distal section inserted in the spline receptacle of the screw member such that rotation of the spline member causes rotation of the screw member, and a proximal section opposite the distal section comprising a coupling member attached to the end of the proximal section.

2. The apparatus of claim 1, further comprising an elastemeric sealing member mounted in the first face and in the second face of the cylinder and positioned to provide a fluid seal with the piston.

3. The apparatus of claim 1, wherein the coupling member of the drive spline is a hexagonal head.

4. The apparatus of claim 1, further comprising a flexible bellows extending beyond the coupling member and the proximal end of the piston.

5. The apparatus of claim 1, further comprising a flange member attached to the distal end of the screw member.

6. The apparatus of claim 1, further comprising:

a. a source of hydraulic fluid coupled to the first and second fluid lines, and b. a valve system installed in the first and second fluid lines to permit a user to selectively cause hydraulic fluid to be injected into the cylinder through either the first or second fluid lines.

7. The apparatus of claim 6, wherein said valve system is adapted to cause hydraulic fluid flow to alternate between the first and second fluid lines.

8. The apparatus of claim 1, wherein the screw member comprises at least two spline receptacles positioned on radially opposite sides of the screw member.

9. The apparatus of claim 1, wherein the distal section of the drive spline comprises a conical end region.

10. A junction plate actuator apparatus comprising:

a. a cylinder comprising a wall, a first fluid region, a first fluid port in the wall located at the first fluid region, a second fluid region, a second fluid port in the wall at the second fluid region, a longitudinal channel extending through a central radial region of the first and second fluid regions, a first face at the end of the first fluid region and a second face at the end of the second region;

b. a piston extending through the central channel of the cylinder and comprising a distal end protruding beyond the first or second fluid region of the cylinder, a proximal end protruding beyond the fluid region of the cylinder opposite the region from which the distal end protrudes, and a threaded longitudinal channel;

c. a diaphragm mounted on the piston and sized such that it extends radially outward from the outer surface of the piston to the cylinder wall;

d. a screw member comprising a threaded region rotatably mounted in the central longitudinal channel of the piston, a distal region extending beyond the distal end of the piston and adapted to be connectable to a junction plate, a proximal region extending beyond the proximal end of the piston, and a longitudinal spline receptacle; and e. a drive spline having a distal section inserted in the spline receptacle of the screw member such that rotation of the spline member causes rotation of the screw member, and a proximal section opposite the distal section comprising a coupling member attached to the end of the proximal section.

11. The apparatus of claim 10 further comprising a remotely operated vehicle comprising a female receptacle coupled to the coupling member of the drive spline.

12. The apparatus of claim 10, further comprising an elastemeric sealing member mounted in the first face and in the second face of the cylinder and positioned to provide a fluid seal with the piston.

13. The apparatus of claim 10, further comprising a flange member attached to the distal end of the screw member.

14. The apparatus of claim 10 further comprising a junction plate half connected to the distal region of the screw member.

15. The apparatus of claim 10, further comprising a flexible bellows extending beyond the coupling member and the proximal end of the piston.

16. The apparatus of claim 10, wherein the screw member comprises at least two spline receptacles positioned on radially opposite sides of the screw member.

17. The apparatus of claim 10, wherein the distal section of the drive spline comprises a conical end region.

18. A junction plate actuator apparatus comprising:

a. a cylinder comprising a wall, a first fluid region, a first fluid port in the wall located at the first fluid region, a second fluid region, a second fluid port in the wall at the second fluid region, a longitudinal channel extending through a central radial region of the first and second fluid regions, a first face at the end of the first fluid region and a second face at the end of the second region;

b. a first fluid line coupled to the first fluid port;

c. a second fluid line coupled to the second fluid port;

d. a piston extending through the central channel of the cylinder and comprising a distal end protruding beyond the first or second fluid region of the cylinder, a proximal end protruding beyond the fluid region of the cylinder opposite the region from which the distal end protrudes, and a threaded longitudinal channel;

e. a diaphragm mounted on the piston and sized such that it extends radially outward from the outer surface of the piston to the cylinder wall;

f. a screw member comprising a threaded region rotatably mounted in the central longitudinal channel of the piston, a distal region extending beyond the distal end of the piston and adapted to be connectable to a junction plate, a proximal region extending beyond the proximal end of the piston, and a longitudinal spline receptacle;

g. a drive spline having a distal section inserted in the spline receptacle of the screw member such that rotation of the spline member causes rotation of the screw member, and a proximal section opposite the distal section comprising a coupling member attached to the end of the proximal section;

h. a flange member attached to the distal end of the screw member; and i. a junction plate half attached to the flange member.

19. The apparatus of claim 18 further comprising:

a. a female receptacle coupled to the coupling member of the drive spline; and b. a remotely operated vehicle attached to the female receptacle.

20. The apparatus of claim 18, further comprising an elastemeric sealing member mounted in the first face and in the second face of the cylinder and positioned to provide a fluid seal with the piston.

* * * * *